United States Patent [19]

Yaffe et al.

[11] 4,157,970

[45] Jun. 12, 1979

[54] SYNTHETIC AIRCRAFT TURBINE OIL

[75] Inventors: Roberta Yaffe, Glenham; Russell R. Reinhard, Hopewell Junction, both of N.Y.

[73] Assignee: Texaco Inc., New York, N.Y.

[21] Appl. No.: 864,985

[22] Filed: Dec. 27, 1977

[51] Int. Cl.[2] ..... 252 48.6; C10M 1/48

[52] U.S. Cl. ..... 252/46.7; 252/47.5

[58] Field of Search ..... 252/46.7, 47.5, 48.6, 252/565

[56] References Cited

U.S. PATENT DOCUMENTS

| | | | |
|---|---|---|---|
| 2,268,185 | 12/1941 | Burke et al. | 252/48.6 X |
| 3,360,465 | 12/1967 | Warman | 252/565 |
| 3,779,919 | 12/1973 | Patmore et al. | 252/47.5 X |

*Primary Examiner*—Delbert E. Gantz
*Assistant Examiner*—Andrew Metz
*Attorney, Agent, or Firm*—Thomas H. Whaley; Carl G. Ries; James F. Young

[57] ABSTRACT

Synthetic lubricating oil composition having improved oxidation stability comprising a major portion of an aliphatic ester base oil having lubricating properties formed by the reaction of pentaerythritol and an organic monocarboxylic acid and containing a phenylnaphthylamine, a dialkyldiphenylamine, a polyhydroxy anthraquinone, a hydrocarbyl phosphate ester and an organic sulfur containing compound as hereinafter described.

10 Claims, No Drawings

SYNTHETIC AIRCRAFT TURBINE OIL

BACKGROUND OF THE INVENTION

1. Field of the Invention

This invention is concerned with a pentaerythritol ester base lubricating oil composition for a gas turbine engine. Gas turbine engines are operated under a wide range of temperature conditions. The lubricant must be fluid at extremely low temperatures and at the same time retain its lubricating properties in an engine which produces internal operating temperatures at 450°-550° F. or above. The lubricant is subjected to severe oxidation stresses under the high running temperatures encountered in such engines.

Ester base lubricating oil compositions prepared from pentaerythritol and a mixture of fatty acids and containing selected additive combinations are well known. These lubricants are functional over a wide temperature range and exhibit good thermal and oxidative stability. The search for a still more effective, long lived ester base lubricant composition, however, is a major goal of lubricant manufacturers. In addition, more advanced gas turbine engines currently being developed and tested will put higher stresses on the lubricant composition and are projected to require improved lubricant compositions.

2. Summary of the Invention

The synthetic lubricating oil composition of the invention comprises a major portion of an aliphatic ester base oil containing a phenyl-naphthylamine, a dialkyldiphenylamine, a polyhydroxy anthraquinone, a hydrocarbyl phosphate ester and an ester of mercapto-propionic or mercaptoglycolic acid. More specifically, the lubricating oil composition of the invention comprises a major portion of an aliphatic ester base oil formed from the reaction of pentaerythritol and an organic monocarboxylic acid having from about 2 to 18 carbon atoms per molecule containing:

(a) from about 0.3 to 5 percent by weight of the lubricating oil composition of phenyl naphtylamine or an alkyl or alkaryl derivative of phenyl naphthylamines in which the alkyl radicals contain from 4 to 12 carbon atoms, (b) from about 0.3 to 5 percent by weight of a dialkyldiphenylamine in which the alkyl radicals contain from 4 to 12 carbon atoms, (c) from about 0.01 to 0.5 percent by weight of a polyhydroxyanthraquinone, (d) from about 0.25 to 10 percent by weight of a hydro carbyl phosphate ester in which said hydrocarbyl radical contain an aryl ring and has from about 6 to 18 carbon atoms, and (e) from about 0.01 to 5.0 percent by weight of an organic sulfur containing compound as hereinafter described.

The lubricating oil composition of the invention provides substantial improvements in oxidative stability, particularly excellent control of acidity and viscosity increase under severe oxidizing conditions.

DETAILED DESCRIPTION

The base fluid component of the composition of the invention is an ester-base fluid prepared from pentaerythritol and a mixture of hydrocarbyl monocarboxylic acids. Polypentaerythritols, such as dipentaerythritol, tripentaerythritol and tetrapentaerythritol can also be employed in the reaction to prepare the base oil.

The hydrocarbon monocarboxylic acids which are used to form the ester-base fluid include the straight-chain and branched-chain aliphatic acids, as well as mixtures of these acids. The acids employed have from about 2 to 18 carbon atoms per molecule, and preferably from about 5 to 10 carbon atoms. Examples of suitable acids are acetic, propionic, butyric, valeric, isovaleric, caproic, decanoic, dodecanoic, tertiarybutylacetic and 2-ethylhexanoic acid, including mixtures.

In general, the acids are reacted in proportions leading to a completely esterified pentaerythritol or polypentaerythritol with the preferred ester bases being the pentaerythritol tetraesters. Examples of such commercially available tetraesters include pentaerythritol tetracaproate, which is prepared from purified pentaerythritol and crude caproic acid containing other $C_{5-10}$ monobasic acids. Another suitable tetraester is prepared from a technical grade pentaerythritol and a mixture of acids comprising 38 percent valeric, 13 percent 2-methyl pentanoic, 32 percent octanoic and 17 percent pelargonic acids, by weight.

The ester base fluid comprises the major portion of the fully formulated synthetic ester base lubricating oil composition. In general, this ester base fluid is present in concentrations from about 90 to 98 percent of the composition, by weight.

The essential alkyl or alkaryl phenyl naphthylamine component of the invention is represented by the formula:

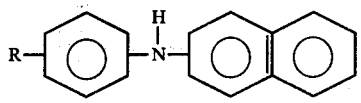

in which R may be H or is an alkyl radical containing from about 4 to 12 carbon atoms or an alkaryl radical containing from 7 to 12 carbon atoms. This radical can be straight or branched chain alkyl radical with the tertiary alkyl structure being preferred or it can be an alkylaryl radical.

Specific effective compounds of this class include phenyl naphthylamine, N-(para-tertiary-octylphenyl)-$\alpha$ or $\beta$-naphthylamine, N-(4-cumylphenyl)$\alpha$ or $\beta$-naphthylamine and the corresponding paratertiary-dodecylphenyl and paratertiary-butylphenyl alpha-and beta-naphthylamines. The preferred naphthylamines are those in which R is H or a tertiary alkyl radical having from 6 to 10 carbon atoms therein. The preferred concentration of this component is from about 0.5 to 2.5 percent by weight.

Another essential component of the lubricating oil composition of the invention is a dialkyldiphenylamine. These compounds are represented by the formula:

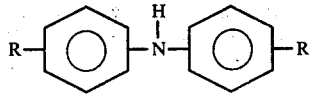

in which R is an alkyl radical having from about 4 to 12 carbon atoms. Suitable alkylamines include dioctyldiphenylamine, didecyldiphenylamine, didodecyldiphenylamine, dihexyldiphenylamine and similar compounds. Dioctyldiphenylamine is the preferred compound and the preferred concentration is from 0.5 to 2.0 percent by weight.

The essential metal deactivator of the lubricating oil composition of the invention is a polyhydroxyanthraquinone. Suitable compounds in this class are the dihydroxyanthraquinones such as 1,4-dihydroxyanthraquinone and 1,5-dihydroxyanthraquinone and the higher polyhydroxyanthraquinones such as 1,2,5,8 tetrahydroxyanthraquinone. The preferred concentration of this component is from about 0.05 to 0.15 weight percent.

Another component of the lubricating oil composition of the invention is a hydrocarbyl phosphate ester, more specifically a trihydrocarbyl phosphate in which the hydrocarbyl radical is an aryl or alkaryl, radical or mixture thereof containing from 6 to 18 carbon atoms and preferably from 6 to 12 carbon atoms. Effective specific compounds include tricresylphosphate. These compounds are preferably in the lubricating oil composition in a concentration ranging from about 0.5 to 5 wt. %.

Another essential component of the lubricating oil composition is an organic sulfur containing compound represented by the formula

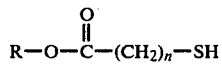

where R is a straight or branched chain alkyl radical having from about 4 to about 12 carbon atoms therein, and n is 1 or 2.

Suitable organic sulfur containing compounds include ethyl-, propyl-, butyl-, pentyl-, hexyl-, heptyl-, octyl-, nonyl-, decyl-, undecyl-, and dodecyl-esters of thioglycolic acid or thiopropionic acid, including the isomers thereof.

This constituent is present in the lubricating oil composition in an amount of from about 0.01 to about 5.0%, preferably in a concentration range of from about 0.05 to about 1%, by weight.

The novel lubricating oil compositions of the present invention exhibit improved oxidation stability particularly excellent control of acidity and viscosity increase under severe oxidizing conditions.

The ester base oil employed in preparing the lubricating oil composition of the invention comprised pentaerythritol containing a minor amount of dipentaerythritol esterified with a mixture of fatty acids. It consisted of technical grade pentaerythritol ester made from a mixture of carboxylic acids consisting of (mole %):

| | |
|---|---|
| i-$C_5$ | 8 ± 3% |
| n-$C_5$ | 23 ± 5% |
| n-$C_6$ | 20 ± 5% |
| n-$C_7$ | 27 ± 5% |
| n-$C_8$ | 7 ± 3% |

-continued

| | |
|---|---|
| n-$C_9$ | 16 ± 3% |

This ester base oil had the following properties:

| | |
|---|---|
| Viscosity, cs at 210° F. | (5.01) |
| Viscosity, cs at 100° F. | (25.6) |
| Viscosity, cs at −40° F. | (7005) |
| Viscosity Index | (140) |
| Flash, °F. | (515) |

The above ester oil was blended with all of the prescribed essential additives with the exception of the thioacid ester to form a Base Fluid. Based on a fully formulated lubricant composition, the Base Fluid consisted of about 95.4 weight percent of the ester base oil described above with 1.5 weight percent of t-octyl-phenyl-α-naphthylamine, 1.0 weight percent of dioctyldiphenylamine, 2.0 weight percent of tricresylphosphate and 0.1 weight percent of quinizarin.

The oxidation-stability of the lubricants of the invention as compared to the Base Fluid was determined in the Rolls Royce (RR 1001) Oxidation Test. (D. Eng. R.D. 2497 Supplement Method No. 12). The results are set forth in the following Table.

TABLE

| | ROLLS ROYCE (RR 1001) OXIDATION TEST 260° C./6 HRS. | | | | | | | |
|---|---|---|---|---|---|---|---|---|
| | Base Fluid | Base Fluid + 0.05 wt. % Additive "A" | Base Fluid | Base Fluid + 0.1 wt. % Additive "A" | Base Fluid | Base Fluid + 0.1 wt. % Additive "B" | Base Fluid | Base Fluid + 0.5 wt. % Additive "B" |
| % Viscosity Change at 100° F. | 90.0 | 48.6 | 96.7 | 50.4 | 81.8 | 25.2 | 81.9 | 46.0 |
| Total Acid Number Change | 4.0 | 2.65 | 4.09 | 3.23 | 3.66 | 1.22 | 4.76 | 3.14 |

Additive "A" - i-octylmercaptoglycolate
Additive "B" -i-octyl mercaptopropionate The data in the Table above show that the oxidative stability of the lubricating oil compositions of the present invention are significantly improved in comparison to the Base Fluid.

In comparison to the Base Fluid, the thioglycolate species of the invention showed a reduction in Viscosity Increase of about 46% at 0.05% wt. concentration and actual reduction of 47.8% at 0.1 wt. % concentration.

At 0.1 wt. % concentration, the thiopropionate species of the invention showed a 63.9% decrease in Viscosity Increase in comparison to the Base Fluid and at 0.5% concentration a 43.8% decrease.

The Total Acid Number change in the thiopropionate species at 0.1 and 0.5 wt. % concentrations were less than the Base Fluid and similar good results were obtained with the thioglycolate species at 0.1 wt. % concentration.

The lubricating oil compositions containing the thiopropionate species were further evaluated at 0.1 wt. % concentration in the Pratt and Whitney Aircraft Specification PWA-521C Oxidation-Corrosion Test 425° F./48 HRS. and the Navy MIL-L-23699B Specification 400° F./72 HRS. Oxidation Corrosion Test and were found to satisfy completely these specification requirements.

Obviously, many modifications and variations of the invention as hereinbefore set forth may be made without departing from the spirit and scope thereof and therefore only such limitations should be imposed as are indicated in the appended claims.

We claim:

1. A synthetic lubricating oil composition consisting of a major portion of an aliphatic ester base oil having lubricating properties formed from the reaction of pentaerythritol or a polypentaerythritol or trimethylolpropane and an organic monocarboxylic acid having from about 2 to 18 carbon atoms per molecule, and:

(a) from about 0.3 to 5 percent by weight of the lubricating oil composition of a phenylnaphthylamine or an alkyl or alkaryl phenyl naphthylamine in which the alkyl radical has from 4 to 12 carbon atoms, (b) from about 0.3 to 5 percent by weight of a dialkyldiphenylamine in which the alkyl radicals have from 4 to 12 carbon atoms, (c) from about 0.01 to 0.5 percent by weight of a polyhydroxy-substituted anthraquinone, (d) from about 0.25 to 10 percent by weight of a hydrocarbyl phosphate ester in which said hydrocarbyl radical contains an aryl ring and contains from about 6 to 18 carbon atoms, and (e) from about 0.01 to about 5.0 percent by weight of an organic sulfur containing compound represented by the formula $$R-O-\overset{\overset{\displaystyle O}{\|}}{C}-(CH_2)_n-SH$$

wherein R is a straight or branched chain alkyl radical having from about 4 to about 12 carbon atoms therein, and n is 1 or 2.

2. A lubricating oil composition as claimed in claim 1 wherein said organic sulfur containing compound is a $C_6$-$C_{10}$ alkyl thioglycolate.

3. A lubricating oil composition as claimed in claim 1 wherein said organic sulfur containing compound is a $C_6$-$C_{10}$ alkyl thiopropionate.

4. A lubricating oil composition as claimed in claim 1 containing from about 0.05 to about 1.0 percent by weight of said organic sulfur containing compound.

5. A lubricating oil composition as claimed in claim 1 wherein the naphthylamine is octylphenyl-alpha-or-beta-naphthylamine.

6. A lubricating oil composition as claimed in claim 1 containing from about 0.5 to 2.0 percent of a dialkyldiphenylamine, by weight.

7. A lubricating oil composition as claimed in claim 1 containing from about 0.01 to 0.5 percent of said polyhydroxy-substituted anthraquinone, by weight.

8. A lubricating oil composition as claimed in claim 7 wherein the polyhydroxy-substituted anthraquinone is 1,4 dihydroxyanthraquinone.

9. A lubricating oil composition as claimed in claim 1 containing from about 0.5 to 5 percent of a hydrocarbyl phosphate ester, by weight.

10. A lubricating oil composition as claimed in claim 1 wherein the aliphatic ester base oil is present in a concentration of from about 90 to 98 percent of the composition, by weight.

* * * * *